US012385278B2

(12) United States Patent
Grant

(10) Patent No.: US 12,385,278 B2
(45) Date of Patent: Aug. 12, 2025

(54) FENCE WITH INTEGRATED GUARD

(71) Applicant: Keith Grant, Chester Springs, PA (US)

(72) Inventor: Keith Grant, Chester Springs, PA (US)

( * ) Notice: Subject to any disclaimer, the term of this patent is extended or adjusted under 35 U.S.C. 154(b) by 0 days.

(21) Appl. No.: 18/119,539

(22) Filed: Mar. 9, 2023

(65) Prior Publication Data

US 2023/0212874 A1 Jul. 6, 2023

Related U.S. Application Data

(63) Continuation of application No. 16/121,685, filed on Sep. 5, 2018, now abandoned.

(60) Provisional application No. 62/554,599, filed on Sep. 6, 2017.

(51) Int. Cl.
*E04H 17/06* (2006.01)
*E04H 17/04* (2006.01)

(52) U.S. Cl.
CPC ..... *E04H 17/063* (2013.01); *E04H 17/05* (2021.01)

(58) Field of Classification Search
CPC .... A01G 9/28; A01G 13/0256; A01K 15/006; A01K 15/04; A01K 1/03–126; A01K 31/00; A01K 31/02; A01K 31/06; A01K 31/07; A01K 31/08; A01K 31/10; A01K 3/00; A01K 3/001; A01M 21/00; A01M 29/30; E01F 15/0469
USPC ..... 256/1, 32; 52/102; D25/38.1, 164
See application file for complete search history.

(56) References Cited

U.S. PATENT DOCUMENTS 3,983,845 A * 10/1976 Roehrig ..... A01K 1/04 119/784
4,548,388 A * 10/1985 Cobler ..... E04H 17/063 256/32
4,903,947 A * 2/1990 Groves ..... A01G 9/28 256/32
8,820,722 B2 * 9/2014 Reinert, Sr. ..... E04H 17/17 256/65.14
10,428,551 B1 * 10/2019 Bloomfield ..... E04H 17/063
2005/0218393 A1 * 10/2005 Larsen ..... E04H 17/161 256/32
2009/0321701 A1 * 12/2009 Payne ..... E04H 17/161 256/57
2012/0097909 A1 * 4/2012 Smith ..... E04H 17/16 256/24
2015/0021532 A1 * 1/2015 Smith ..... E04H 17/05 256/65.01
2015/0048290 A1 * 2/2015 Volin ..... E04H 17/161 256/24
2023/0026173 A1 * 1/2023 Mullin ..... E04H 17/063

FOREIGN PATENT DOCUMENTS

KR 20100003388 A * 11/2010 ..... E04H 17/10

* cited by examiner

*Primary Examiner* — Amber R Anderson
*Assistant Examiner* — Zachary A Hall
(74) *Attorney, Agent, or Firm* — Joseph E. Maenner; Maenner & Associates, LLC

(57) ABSTRACT

A fence with an integrated guard includes a fence having a bottom end and a guard attached to the lower end of the fence. The guard can wrap around the bottom end of the fence. Alternatively, the guard can extend downwardly from the fence. Still alternatively, the guard can extend between adjacent horizontal members of the fence.

11 Claims, 2 Drawing Sheets

FENCE WITH INTEGRATED GUARD

CROSS-REFERENCE TO RELATED APPLICATION

The present application claims priority from U.S. Provisional Patent Application Ser. No. 62/554,599, filed on Sep. 6, 2017, which is incorporated herein by reference in its entirety.

BACKGROUND OF THE INVENTION

Field of the Invention

The present invention relates to wire fencing and, more specifically, to a wire fence having an integrated guard that is used to line the lower perimeter of the fence, preventing the growth of grass and weeds therein, as well as providing a constant barrier against which a rotating weed cutting device can be applied to reduce the breakage of weed cutting elements and reduce damage to the wire fence.

Description of the Related Art

Those who use metal mesh fencing to enclose an outdoor space know all too well of the difficulties associated with keeping weeds and grasses from growing in between the structural members of the fence. The grass and weeds get entangled in the fence mesh, making it difficult to remove, even with conventional powered rotating line cutters. The metal mesh tends to shield the grass and weeds and also tends to sever the trimmer filament line.

It would be beneficial to provide a fence guard that prevents or growth of grass and weeds in the mesh of a metal mesh fence, and also provides a surface that enables the use of rotating line cutters that will reduce the breakage of the filament lines used therewith.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is a mesh fence assembly including a mesh fence and a lower border guard that prevents the growth of weeds and grass in between mesh members.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION

Figure 1:
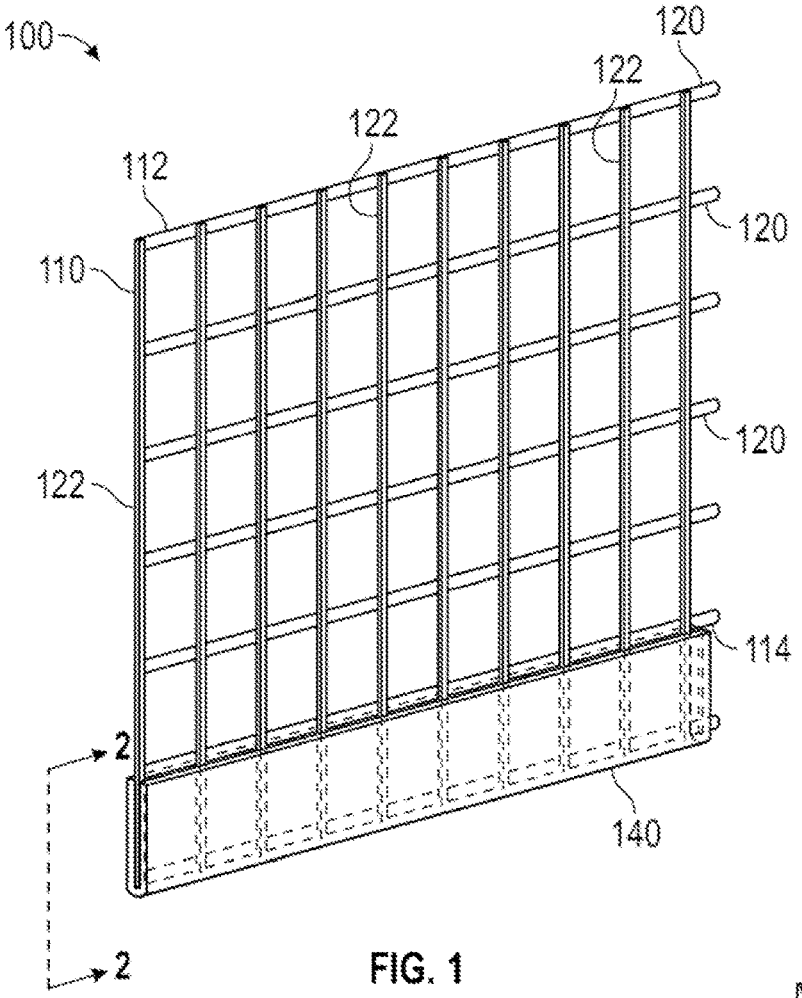
FIG. 1 is a perspective view of a fence assembly according to an exemplary embodiment of the present invention.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

The present invention provides a temporary appliqué to the front of a cricket bat that provides a visual indication of where on the bat that a cricket ball struck during a swing. While one use of the present invention is, those skilled in the art will recognize that the present device can have other applications as well.

Referring to the Figures, a mesh fence assembly 100 ("assembly 100") according to an exemplary embodiment of the present invention is shown. Assembly 100 includes a wire mesh fence 110 and an integrated guard 140. Fence 100 has a top end 112 and a bottom end 114, with a first plurality of horizontal members 120 extending generally parallel to each other and a second plurality of vertical members 122 extending generally parallel to each other and orthogonal to the first plurality of horizontal members 120. In an exemplary embodiment, adjacent horizontal members 120 are spaced from each other by a distance of about 4 inches, and adjacent vertical members 122 are spaced from each other by a distance of about 1 inch, although those skilled in the art will recognize that members 120, 122 can be spaced different distances from those listed above.

While fence 110 in the form of an orthogonal grid is shown in FIG. 1, those skilled in the art will recognize that fence 110 can be constructed using other configurations, such as a hexagonal configuration commonly found in chicken wire (not shown) or other configurations.

Figure 2:
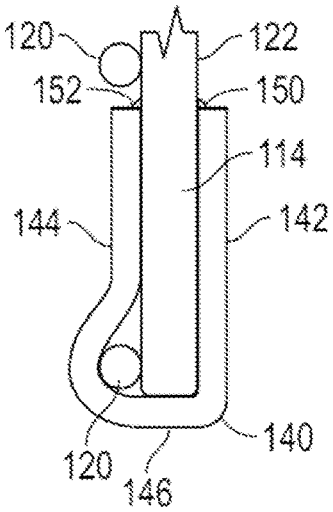
FIG. 2 is a sectional view of the fence assembly of FIG. 1, taken along lines 2-2 of FIG. 1.

Guard 140 is shown in FIG. 2 as being generally U-shaped in cross section, with a first portion 142 of guard 140 located on a first side of fence 110, a second portion 144 of guard 140 located on an opposing side of fence 110, and a connecting portion 146 below fence 110, connecting first portion 142 with second portion 144. Guard 140 can extend upwardly from the bottom end 114 of fence 110 a distance of between about 2 inches and about 4 inches, although those skilled in the art will recognize that guard 140 can extend upward a distance less than about 2 inches or greater than about 4 inches.

While guard 140 is shown as extending on both sides of fence 110, those skilled in the art will recognize that guard 140 can extend only along a single side of fence 110, and omit second portion 144 and connecting portion 146. Further, while fence 110 is shown as a mesh fence, guard 140 can be solid so that no openings extend through guard 140.

In an exemplary embodiment, fence 110 can be constructed from carbon steel that is galvanized or rubber coated to retard rust. Additionally, guard 140 can be constructed from sheet metal, which can be galvanized or rubber coated to retard rust. Alternatively, guard 140 can be constructed from a polymer, such as, for example, PVC, nylon, tetrafluoroethylene, a rubber, or other suitable material that will withstand an exterior environment. Guard 140 is sufficiently thin to allow assembly 100 to be rolled into a coil for shipping and storage.

If both fence 110 and guard 140 are constructed from metal, guard 140 can be welded to fence 110 where fence 110 contacts guard 140. By way of example only, guard 140 can be welded to fence 110 at welds 150, 152, shown in FIG. 2.

If guard 140 is a polymer, guard 140 can be heat applied to bottom end 114 of fence 110 such that first portion 142 of guard 140 is melted to second portion 144 of guard 140 at least around some of horizontal members 120 and/or vertical members 122, forming a rigid connection between first portion 142 and second portion 144 of guard 140 and locking guard 140 to fence 110.

While fence 110 is contemplated as being a rigid structure, thereby enabling assembly 100 to be coiled in a roll for shipping and storage, the present invention does not rule out the use of guard 140 with a different type of fence, such as, for example, a cyclone fence.

Figure 3:
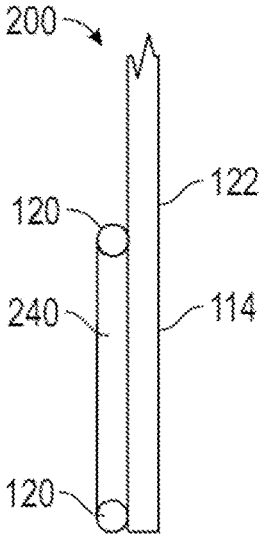
FIG. 3 is a side elevational view of aa fence assembly according to an alternative embodiment of the present invention.

Referring to FIG. 3, an alternative embodiment of a mesh fence assembly 200 ("assembly 200") according to an alternative exemplary embodiment of the present invention is shown. Assembly 200 can include fence 100 as described above. Instead of guard 140 that wraps around both sides of fence 110, a guard 240 extends only along one side of fence 110 and extends between adjacent horizontal members 120, with the lowest of the adjacent horizontal members 120 being at the bottom of fence 110 so that guard 240 is proximate to the ground.

If both fence 110 and guard 240 are constructed from metal, guard 240 can be welded to fence 110 at or along horizontal members 120.

Figure 4:
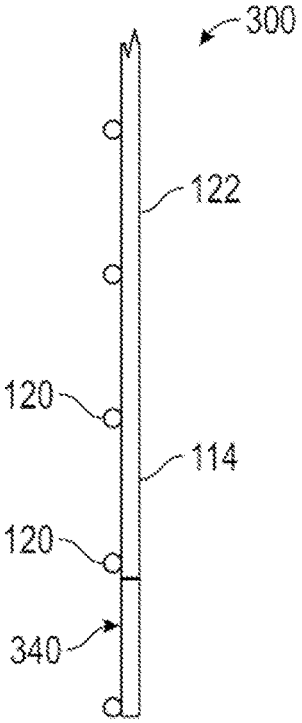
FIG. 4 is a side elevational view of aa fence assembly according to another alternative embodiment of the present invention.

Referring to FIG. 4, an alternative embodiment of a mesh fence assembly 300 ("assembly 300") according to an alternative exemplary embodiment of the present invention is shown. Assembly 300 can include fence 100 as described above. Instead of guard 140 that wraps around both sides of fence 110, a guard 340 extends only from the bottom of fence 110.

If both fence 110 and guard 340 are constructed from metal, guard 340 can be welded to fence 110 at or along the bottom of fence 110.

Figure 5:
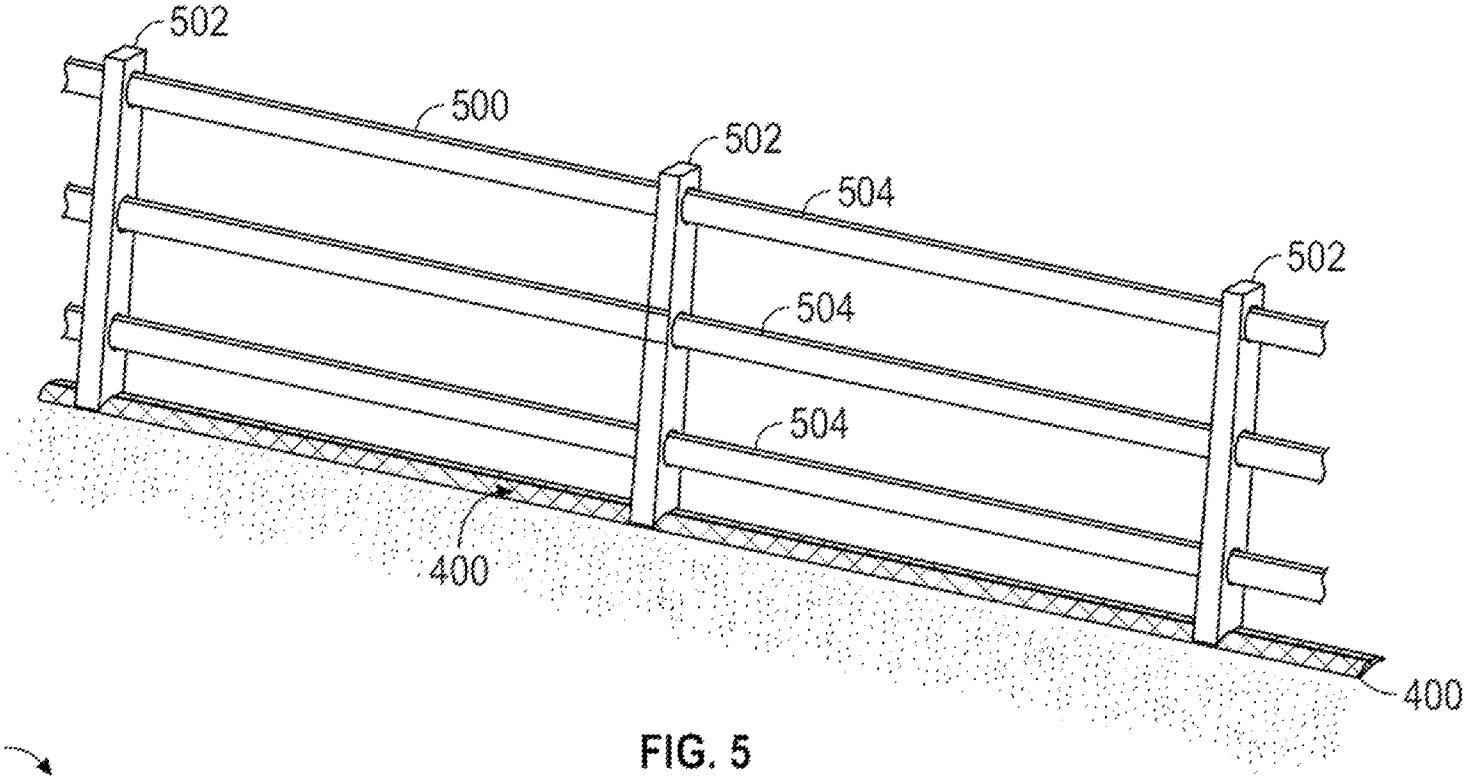
FIG. 5 is a perspective view of a grass mat according to an exemplary embodiment of the present invention.

Referring to FIG. 5, a grass mat 400 ("mat 400") according to the present invention is shown. Mat 400 can be a continuous horizontal mat that is placed under the centerline of a fence, such as fence 110 discussed above, a fence such as fence 500, or any other type of fence. Fence 500 is a post and rail fence with posts 502 and a plurality of horizontal rails 504. Typically, three rows of horizontal rails 504 are used.

Mat 400 can be constructed from a heavy flexible polymer or rubber, including recycled tires. Optionally, mat 400 can be green in color. Mat 400 is used to eliminate the need to spray, trim, or otherwise remove weeds from around a fence. Mat 400 can also be used to discourage pets or other animals from digging under the fence.

Mat 400 can be cut to a desired length, such as the distance between adjacent posts 502 as shown in FIG. 5. Mat 400 can also be provided in differing widths, depending on the amount of grass coverage around fence 500 that is desired. Exemplary widths can be between about 4 inches and about 12 inches, although those skilled in the art will recognize that other widths can be used.

Figure 6:
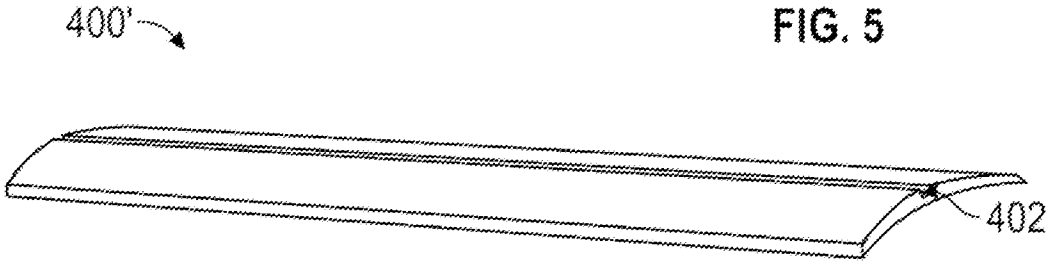
FIG. 6 is a perspective view of a grass mat according to an alternative exemplary embodiment of the present invention.
Figure 7:
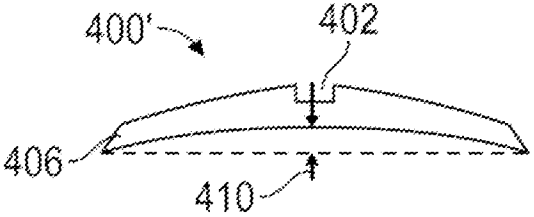
FIG. 7 is a side elevational view of the grass mat of FIG. 6.

Optionally, as shown in FIGS. 6 and 7, a modified mat 400' can be used. Mat 400' is similar to mat 400, but with a longitudinal slot 402 extending along the centerline of mat 400'. Slot 402 is sized to allow a horizontal member 120 of a fence, such as fence 110, to be inserted therein for stability.

Mat 400 or 400' can be between about ½ inch and about ¾ inch thick, although those skilled in the art will recognize that mat 400, 400' can be thinner or thicker. Mat 400, 400' can have an thickness at edge 406 of between about ⅛ inch and about ¼ inch, although those skilled in the art will recognize that edge 406 can be thinner or thicker.

As shown in FIG. 7, mat 400' can have a cambered cross section 410 such that slot 402 is elevated. Cambered cross section 410 helps keep mat 400' in place and flat on the ground with the weight of the fence on slot 402. Cambered cross section 410 can be between about ¼ inch and about ½ inch high.

Optionally, although not shown, stakes or other securing devices can be driven through mat 400, 400' and into the ground to prevent mat 400, 400' from blowing away or otherwise moving out of place from under a fence.

It will be further understood that various changes in the details, materials, and arrangements of the parts which have been described and illustrated in order to explain the nature of this invention may be made by those skilled in the art without departing from the scope of the invention as expressed in the following claims.

I claim:

1. A fence with guard comprising:

a single fence having a bottom end, the bottom end having a bottom horizontal member and a second horizontal member, each attached to a first side of a plurality of non-horizontal members; and a guard at the bottom end of the single fence and encompassing the plurality of non-horizontal members, wherein the guard comprises a first edge, a first planar sheet extending downward from the first edge, a first curved portion extending from the first planar sheet, distal from the first edge, the curved portion curving in a first direction at an obtuse angle around the first horizontal member and then curves in a second direction at an acute angle vertically upwardly along the plurality of vertical members to a second planar sheet, wherein the second planar sheet is parallel to the first planar sheet and extending upwardly to a second edge.

2. The fence with guard according to claim 1, wherein the fence comprises a plurality of separate horizontal members above the second horizontal member.

3. The fence with guard according to claim 2, wherein the plurality of non-horizontal members comprises a plurality of separate vertical members attached to the bottom and the second horizontal members.

4. The fence with guard according to claim 1, wherein the guard extends below the fence.

5. A fence with integrated guard comprising:

a mesh fence having a bottom end, the mesh fence having a plurality of vertical members, a first horizontal member and a second horizontal member, each of the first horizontal member and the second horizontal member extending on a first side of each of the vertical members; and a solid guard extending along the bottom end of the fence and engaging each of the vertical members, wherein the solid guard extends upwardly from the bottom end and covers the first horizontal member and stops below the second horizontal member, wherein a first planar portion of the guard extends vertically downwardly along a second side of the plurality of vertical members, then extends horizontally along a bottom of each of the plurality of vertical members past the first horizontal member, then curves in a first direction at an obtuse angle around the first horizontal member to the first side of the plurality of vertical members, and then curves in a second direction at an acute angle vertically upwardly to a second planar portion, the second planar portion extending along the plurality of vertical members.

6. The fence with integrated guard according to claim 5, wherein the fence has two opposing sides and wherein the guard extends along one of the opposing sides.

7. The fence with integrated guard according to claim 6, wherein the guard extends along a second of the opposing sides.

8. The fence with integrated guard according to claim 5, wherein the guard has a generally U-shaped cross section.

9. The fence with guard according to claim 5, wherein the guard extends at an oblique angle between the first side of the non-horizontal members and the bottom horizontal member.

10. The fence with integrated guard according to claim 5, wherein the guard is welded to the fence.

11. The fence with integrated guard according to claim 5, wherein the fence with integrated guard is configured to be rolled into a coil.

* * * * *